United States Patent [19]

Kang et al.

[11] Patent Number: 5,004,278

[45] Date of Patent: Apr. 2, 1991

[54] DOOR LOCK HAVING SECURITY DEVICE

[76] Inventors: Cheong J. Kang, 522-8, Songnae-1 Dong, Kangdong-ku, Seoul; Seok J. Kang, 7-12 Seokgyo-Dong Cheongju, Chung Cheong Bukdo, both of Rep. of Korea

[21] Appl. No.: 439,442

[22] Filed: Nov. 20, 1989

[30] Foreign Application Priority Data

May 25, 1989 [KR] Rep. of Korea ..... 7012

[51] Int. Cl.[5] ..... F05C 1/08

[52] U.S. Cl. ..... 292/169.18; 292/336.3; 292/359

[58] Field of Search ..... 292/359, 336.3, 169.14, 292/169.16, 169.18; 70/488, 224

[56] References Cited

U.S. PATENT DOCUMENTS 2,720,408 10/1955 Krupicka ..... 292/169.18
2,847,242 8/1958 Schlage ..... 292/169.18
2,917,337 12/1959 Schlage ..... 292/169.18
3,022,102 2/1962 Russell et al. ..... 292/169.81
4,470,279 9/1984 Neary et al. ..... 292/359
4,920,773 5/1990 Surko, Jr. ..... 70/224

FOREIGN PATENT DOCUMENTS 86591 4/1986 Rep. of Korea .

*Primary Examiner*—Eric K. Nicholson
*Attorney, Agent, or Firm*—Klauber & Jackson

[57] ABSTRACT

An improvement of the door lock which is extensively used in all kinds of doors is disclosed which is characterized in that a security device is added to the existing door lock without modifying the constitution and the operating principle of the existing door lock, so that, once the security device is activated from the inside of the room, the door lock can never be opened by even the corresponding key and other means from the outside, thereby protecting the persons staying inside the room from the attempt of an unpermitted intruder.

6 Claims, 12 Drawing Sheets

DOOR LOCK HAVING SECURITY DEVICE

FIELD OF THE INVENTION

The present invention relates to a door lock usable to all kinds of doors of ordinary buildings, and particularly to a door lock in which a security device is provided to the existing lock in such a manner that the door can never be unlocked from the outside unless the security device is released from the interior of the room.

BACKGROUND OF THE INVENTION

The door lock which is extensively used at present is constituted such that the door is locked if the push knob protruding from the centre of the door handle is pushed in from the interior of the room. However, such a door lock can be easily unlocked by means of an approximately similar key or a metal piece. Furthermore, such a door lock can be easily unlocked by means of an ID card or a name card.

Therefore, when a house wife is staying alone in an apartment and the like, or family members are sleeping during the night with the door lock locked, an unpermitted intruder can easily intrude into the apartment after unlocking the door lock in an easy manner, thereby giving rise to numerous cases of slaughters and other accidents.

An example of such a conventional door lock is disclosed in Korean Utility Model Registration No. 31297 (entitled: Door Lock having a Security Device) granted to the present applicant. The object of the prior art door lock is similar to that of the present invention, but its constitution is quite different from that of the existing door locks. Further, the prior art lock has many problematic features, such as, it occupies too much installation area, and it can not be installed at the position of an existing door lock after removal of it, thereby making it difficult to expect a practical usefullness from this door lock of the prior art.

With reference to the Figures, those parts of the door lock of the present invention which are conventionally known will be described below.

That is, a runner 60 which is coupled with a cylinder 50 at its lower portion and is coupled with a lock plate 62 at its upper portion is installed to a case 30, while its left and right sides are respectively coupled with an outer rotating tube 11 and a movable pipe 40. The outer rotating tube 11 and the movable pipe 40 are respectively coupled with an outer handle 10 and an inner handle 20, while a push knob 48 is slidably inserted into the movable pipe 40. A shaft 27 which is coupled with the push knob 48 at one of its ends is provided with two leading ends 28,29 at another of its ends is installed within the movable pipe 40, while the leading end 29 of the two leading ends extends through the runner 60 installed within the case 30 to an elastic support plate 12 located at the end of the rotating tube 11.

The conventional door lock constituted as described above is further constituted such that a latch 51 elastically supported by means of a spring within the cylinder 50 is engaged with a latch plate (not shown). Under this condition, if the outer and inner handles 10,20 are turned, then the arcuate projections 13,14 of the end of the rotating tube 11 and the arcuate projection 41 of the end of the movable pipe 40 will push the runner 60 upwardly to elevate it as shown in FIGS. 8A and 8B, while the latch 51 engaged with the lower portion thereof is elevated to depart from the latch plate, thereby opening the door. Meanwhile, the operation of locking the door by pushing the push knob 48 is carried out in the manner described below. Upon pushing the push knob 48, the shaft 27 is moved (refer to FIG. 11), in such a manner that the leading end 29 pushes the elastic support piece 12, and that the leading end 28 is inserted into a groove 16 located at the upper portion of the outer rotating tube 11 to prevent the rotation of the outer rotating tube 11. Here, the sliding face 45 of the shaft 27 moves pushing upwardly the lock plate 62 which is elastically installed to the runner 60 by means of a spring 64, while, at the moment sliding face 45 is pushed past the lock plate 62, the lock plate 62 Is restored to the original position due to the force of the spring 64, and a latching face 46 is engaged with the lock plate 62, thereby forming a locked state.

If an unlocking is desired, then the inner handle 20 should be turned, so that the arcuate projection 41 of the leading end of the movable pipe 40 should push up the runner 60, and that the lock plate 62 should be released from the latching face 46 of the shaft 27, thereby restoring the shaft 27 to the original position through the function of the elastic support plate 12 to open the door.

On the other hand, if the outer handle 10 is turned without using the inner handle, the leading end 28 of the shaft 27 is inserted into the groove 16 of the leading end of the outer rotating tube 11 to prevent the rotation of the outer rotating tube 11, and therefore, the arcuate projections 13,14 can not push up the runner 60, so that the door can not be opened.

However, if the key is used as shown in FIG. 8C, although the outer rotating tube 11 is not rotated, an inner rotating tube 15 is rotated owing to the action of the key, so that only the arcuate projection 14 should be rotated to push up the runner 60, thereby releasing the lock plate 62 from the latching face 46 to open the door.

Further, such a door lock can be opened by pushing the latch into the interior of the cylinder 50 through the use of a knife and the like.

Therefore, when a housewife is staying in an apartment and the like with the door locked, or when members of a family are sleeping in night with the door locked, an unpermitted intruder can open the door by means of a corresponding key, a similar key, or by moving the latch through the use of even a knife or a name card.

SUMMARY OF THE INVENTION

The present invention is intended to overcome the disadvantages of the conventional door locks constructed substantially as described above.

Therefore, it is the object of the present invention to provide a door lock in which, if the door is locked from the interior of the room, the door can not be opened even with the corresponding key, as well as making it impossible to open the door with a metal piece, a knife or a name card as in the case of the conventional locks, thereby preventing the intruding of an unpermitted intruder.

In achieving the above object, the device of the present invention is constituted such that a separate security device is installed within the existing movable pipe, so that, upon locking the security device, the arcuate projections of the inner and outer rotating tubes can not be moved, and the latch can not be moved into the interior of the cylinder, thereby making it impossible to open the door even with the corresponding key upon activation of the security device from the inside of the room.

BRIEF DESCRIPTION OF THE DRAWINGS

The above object and other advantages of the present invention will become more apparent by describing in detail the preferred embodiment of the present invention with reference to the attached drawings in which:

FIG. 8 illustrates the actuations of the arcuate projections in which:

DESCRIPTION OF THE PREFERRED EMBODIMENT

Figure 1:
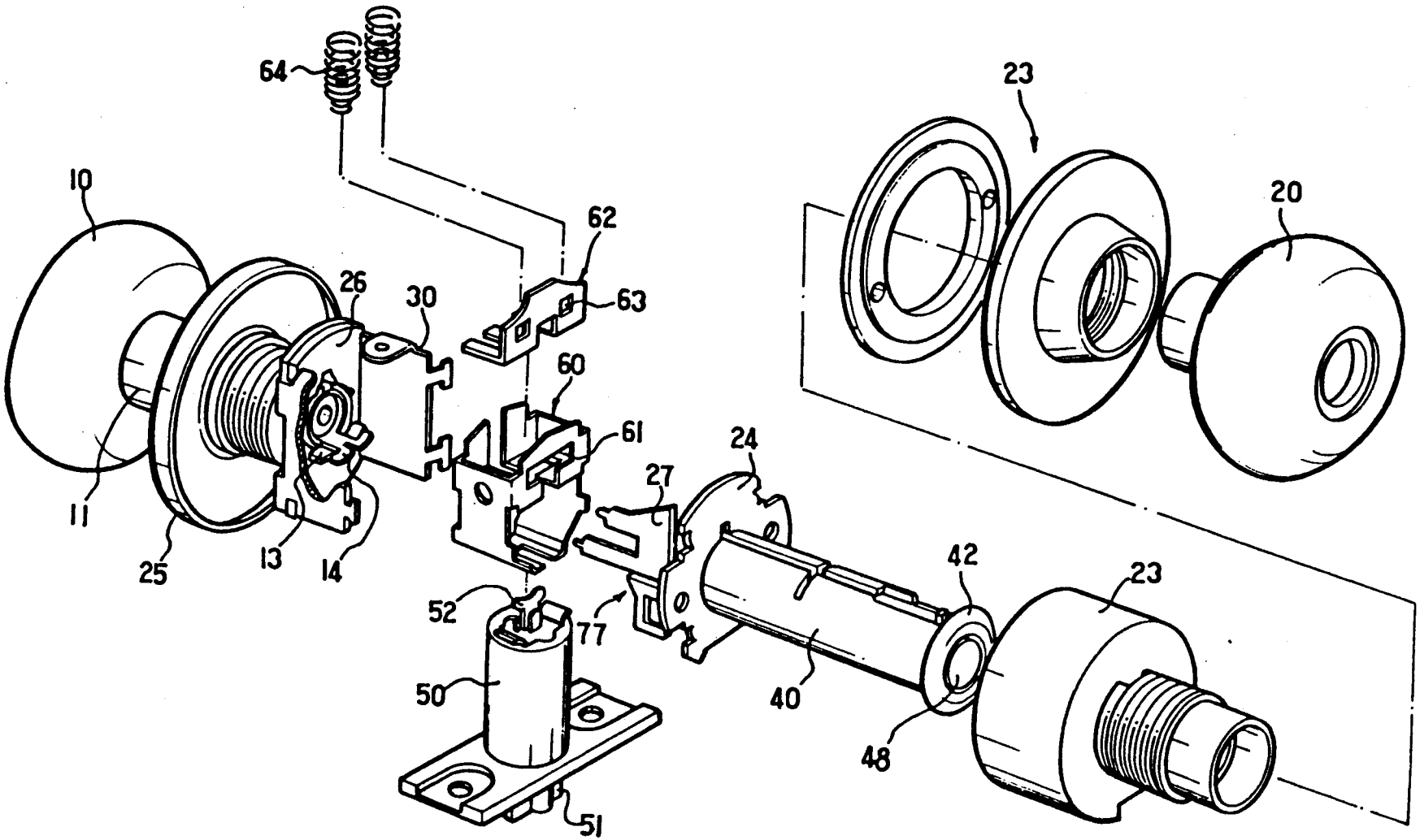
FIG. 1 is an exploded perspective view of the door lock modified in accordance with the present invention.
Figure 2:
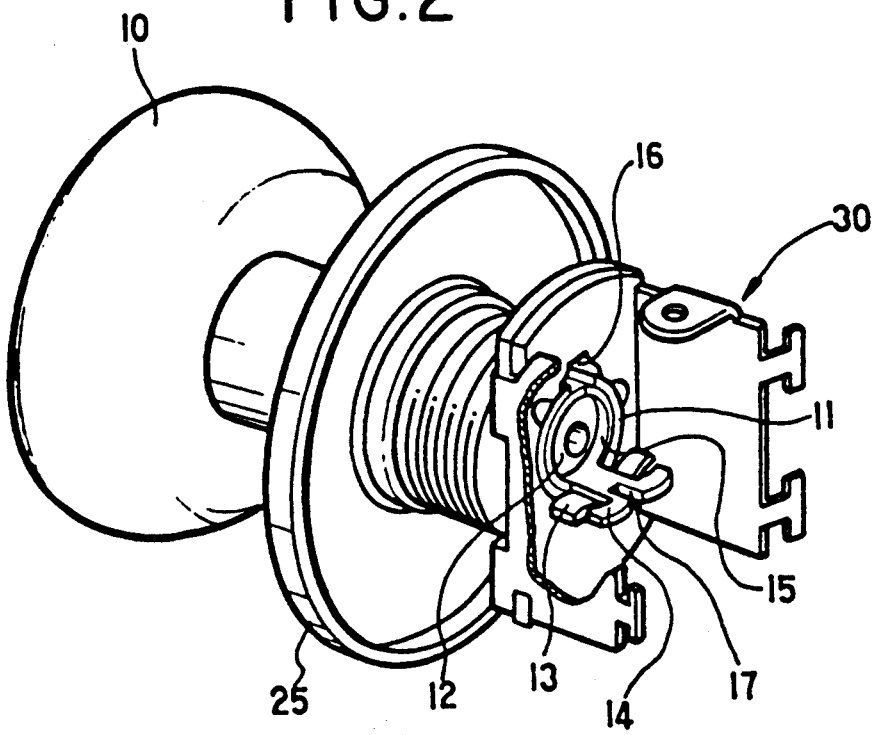
FIG. 2 is an enlarged perspective view of the outer handle portion of the device of FIG. 1.
Figure 3:
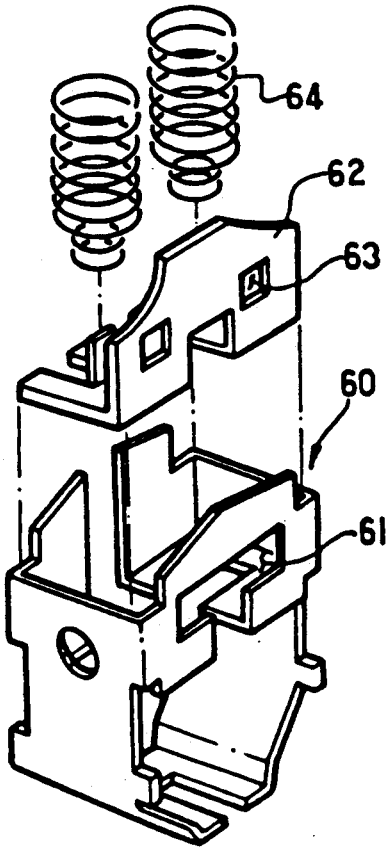
FIG. 3 is an enlarged perspective view of the lock plate and the runner of the device of FIG. 1.
Figure 4:
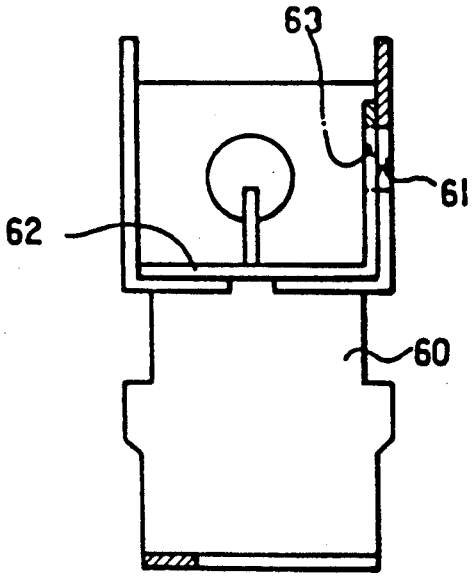
FIG. 4 is a frontal view of the combination of the lock plate and the runner.

With reference to the Figures, the modifications and additions of the present invention are described below. The device of the present invention is constituted such that: a separate security device 70, [see FIGS. 6 and 7] is installed within a movable pipe 40; a lock plate 62 is provided with two insertion holes 63; arcuate projections 13,14 of the ends of outer and inner rotating tubes 11,15 are respectively provided with an insertion hole 17; and the movable pipe 40 is provided with a latching slot 44 for a knob 42 of the security device.

Figure 7:
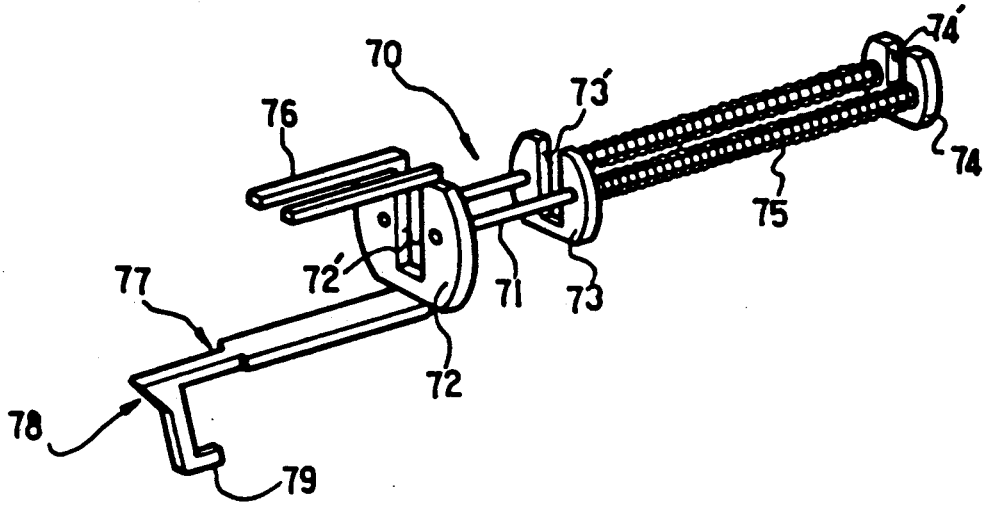
FIG. 7 is a perspective view of the security device to be installed within the movable pipe.
Figure 8A:
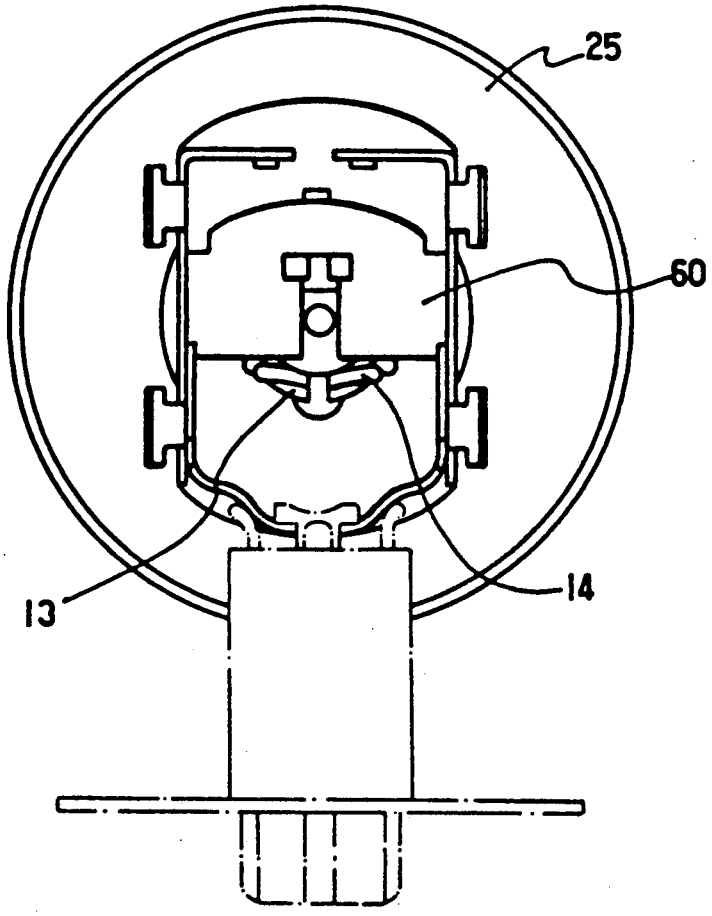
FIG. 8A is a plan view of the arcuate projections with the outer handle not turned.
Figure 8B:
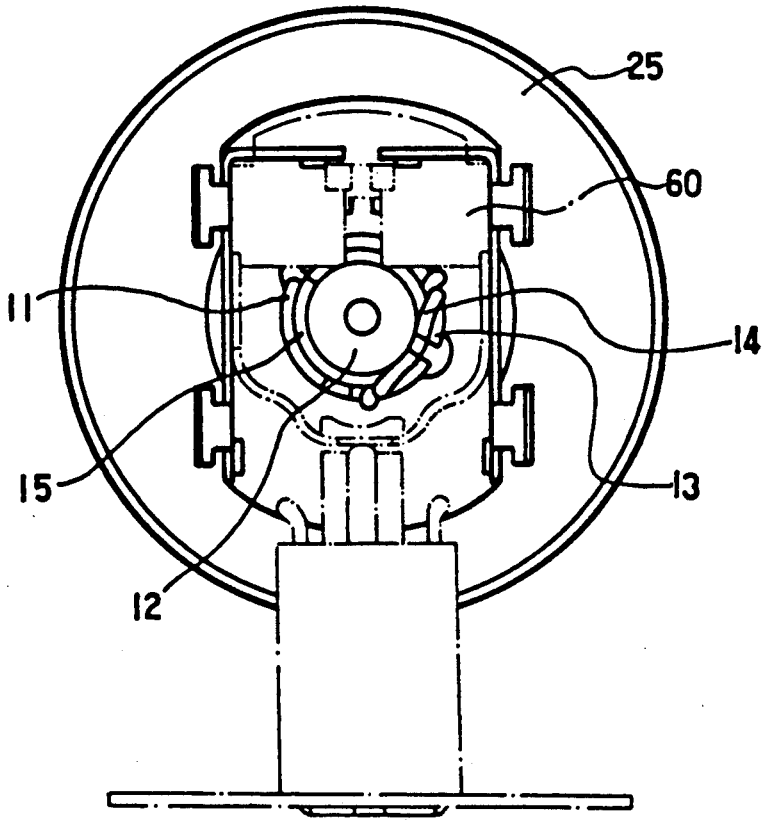
FIG. 8B is a plan view of the arcuate projections in a state in which the arcuate projections are pushing up the runner upon turning of the outer handle.
Figure 8C:
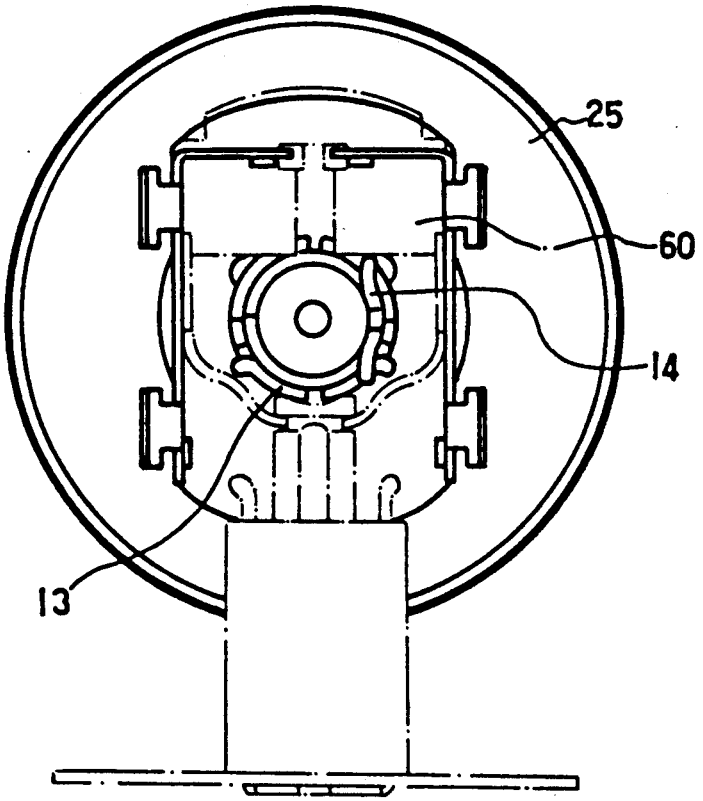
FIG. 8C is a plan view of the arcuate projections in a state in which the arcuate projections are pushing up the runner upon turning of the key.

As shown in FIG. 7, the security device 70 is constituted such that a locking plate 72 and a spring washer 74 are secured to the opposite ends of two circular rods 71, another washer 73 is secured to the centre of the circular rods 71, and a spring 75 is elastically installed between the washers 73,74.

A locking pin 76 is integrally formed with the upper portion of locking plate 72, and a locking pin 77 is provided at the lower portion of the locking plate 72, the locking pin 77 being provided with a leading end 78 and a lower end 79. The locking plate 72, the washer 73 and the washer 74 are provided with insertion slots 72', 73', 74' respectively for inserting a shaft 27.

Figure 5:
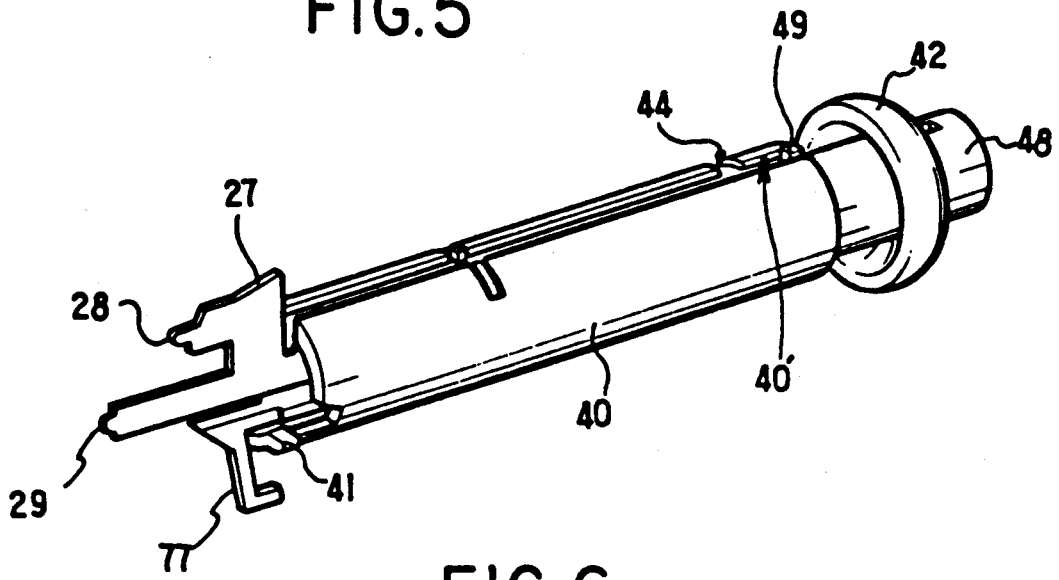
Figure 6:
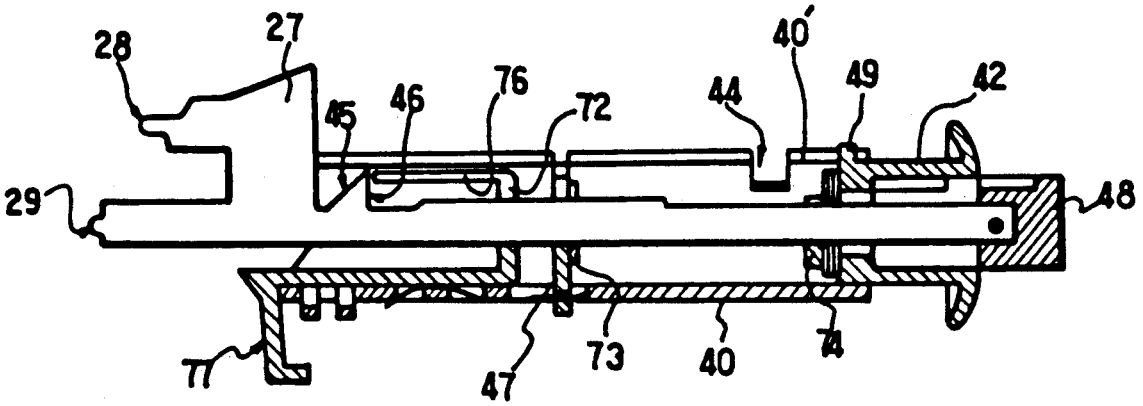
FIG. 6 is a sectional view of the movable pipe.

FIGS. 5 and 6 show the security device 70 installed within the movable pipe 40 as described above.

That is, with the security device 70 installed within the movable pipe 40, the shaft 27 is fitted through the slots 72', 73', 74' of the locking plate 72, the washer 73 and the spring washer 74, while the leading end 78 and the lower end 79 of the locking pin 77 protrude past to the front of the arcuate projection 41 and to the front of the movable pipe 40.

A security device knob 42 is installed on the shaft 27 so as for it to be contacted with the spring washer 74, and a latching protuberance 49 is provided to the security device knob 42.

Figure 9:
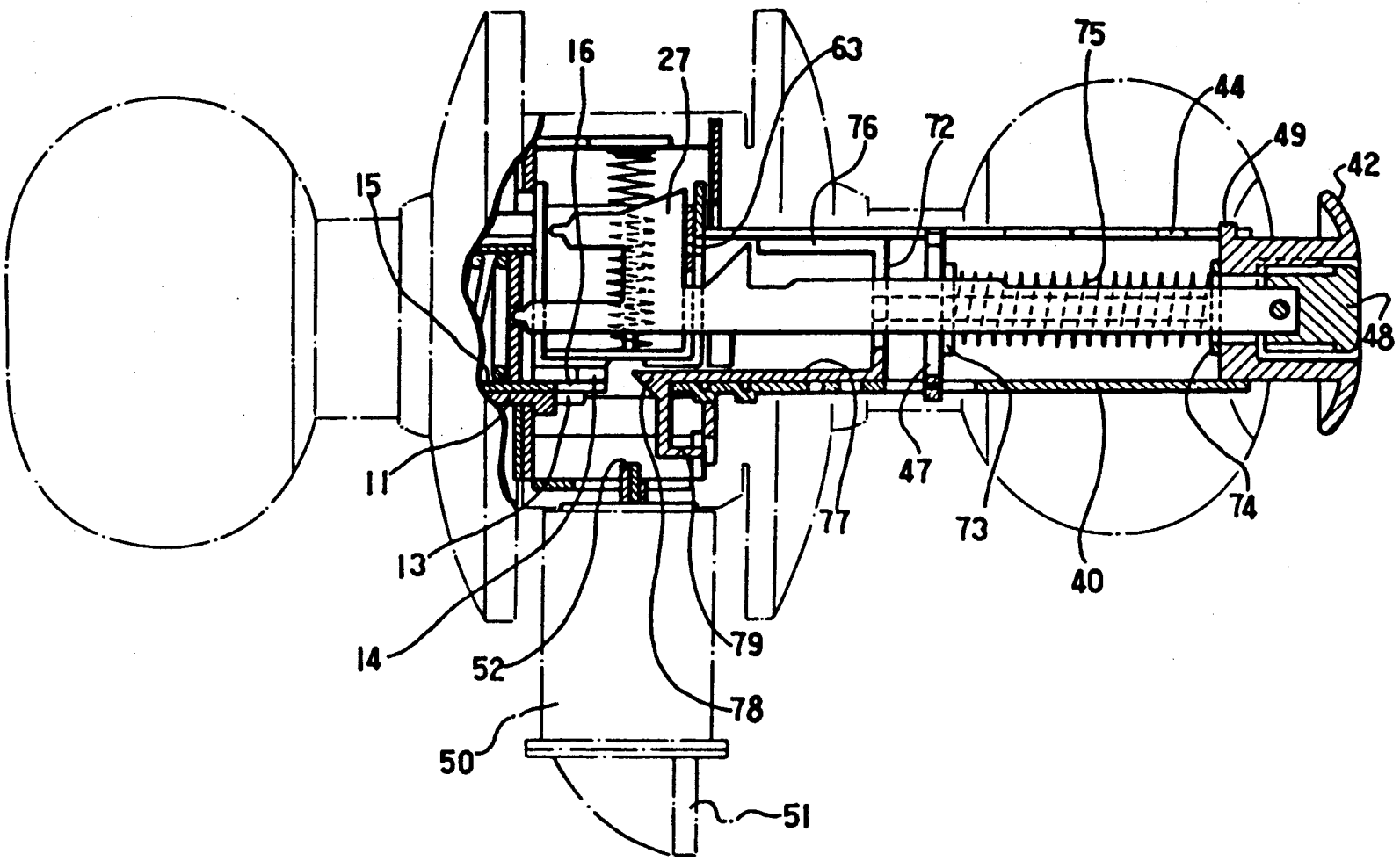
FIG. 9 is a sectional view of the door lock according to the present invention.

Meanwhile, the whole assembly of the device of the present invention is shown in FIG. 9, and, according to this drawing, if the device is in a deactivated state, the leading end 78 and the lower end 79 of the locking pin 77 of the security device 70 are oriented toward the arcuate projection 41 respectively, and the locking pin 76 is also separated from the lock plate 62 and the runner 60. Therefore, in this position, the conventional push button lock is operated in the same way as in conventionally known door locks.

Figure 10:
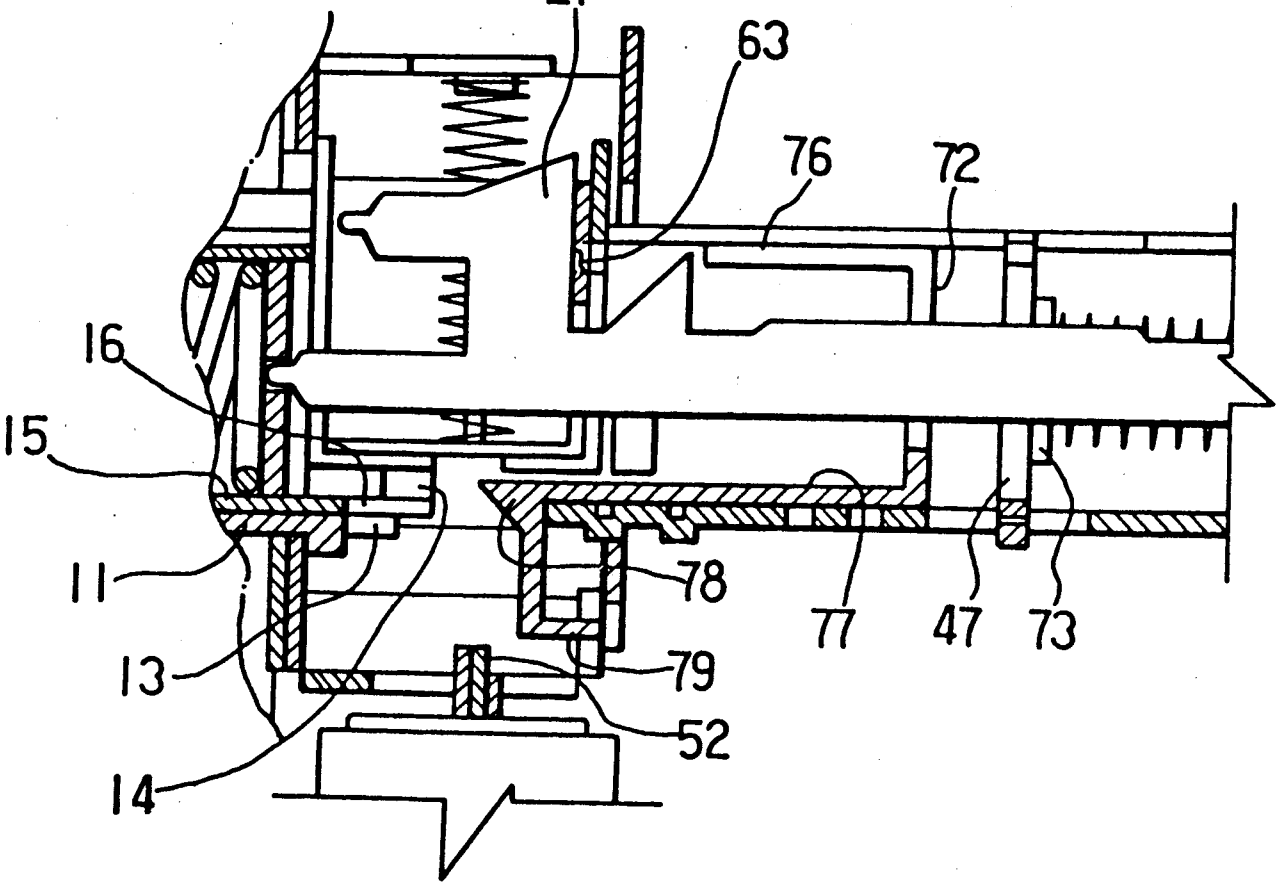
FIG. 10 is an enlarged view of the critical portion of FIG. 9.

FIG. 10 illustrates the case where the security device according to the present invention is activated so that a housewife can protect herself from the intrusion of an unpermitted intruder.

If the security device knob 42 installed at the end of the shaft 27 is pushed forwardly and lightly turned to the right side, then the latching protuberance 49 of the security device knob 42 will advance along an actuation groove 40' to be ultimately latched into the latching slot 44. Accordingly, the spring washer 74 abutted to the security device knob 42 is pushed away, and therefore, the spring 75 is compressed, so that the circular rod 71, the locking pin 76 and the locking pin 77 should be all advanced forwardly. Accordingly it is the result in that the leading end 78 of the locking pin 77 is engaged with insertion slots 17 formed in the arcuate projections 13,14 of the outer and inner rotating tubes 11,15, and that the lower end 79 is positioned immediately above a guide plate 52 of the other end of the latching rod 51.

Accordingly, the outer and inner rotating tubes 11,15 are prevented from being rotated, and therefore, the door can not be opened by turning the door knob from the outside. Further, the outer and inner rotating tubes which are rotatable by means of a key can not be rotated, and therefore, the door can not be opened even with a key.

Further, even if efforts are made to open the door by means of tools such as a knife, the guide plate 52 disposed at the opposite side of the latching rod 51 can not be elevated due to the lower end 79 of the locking pin 77, and therefore, the door also can not be opened. In short, unless the security device is released from the inside of the room, the door absolutely can not be opened.

Meanwhile, in consideration of the fact that, if the security device is activated, the door can not be opened from the outside even with the corresponding key, a provision is made so that a housewife should not inadvertently activate the security device when going out. That is, it is provided that the security device knob 42 of the present invention and the existing push knob 48 should not be activated simultaneously.

That is, as shown in FIG. 10, if the security device is activated, then the locking pin 76 is engaged into the insertion slot 63 of the lock plate 62, and therefore, the lock plate 62 can not be made to ascend by turning the push knob 48 so that the sliding face 45 is latched to prevent the shaft 27 from being advanced thereby preventing any kind of actuation.

Figure 11:
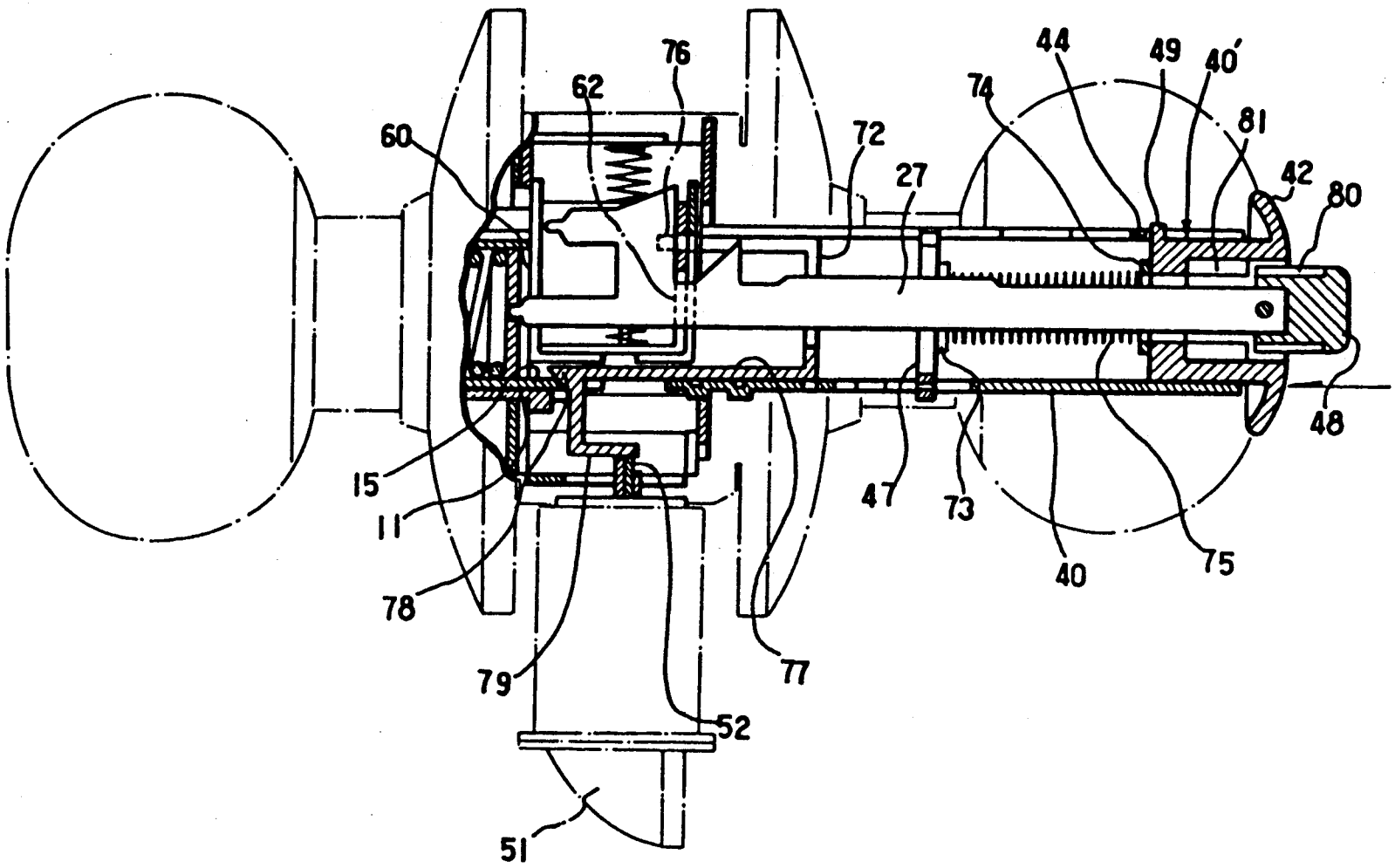
FIG. 11 is a sectional view of the door lock in a locked state upon activation of the security device according to the present invention.
Figure 12:
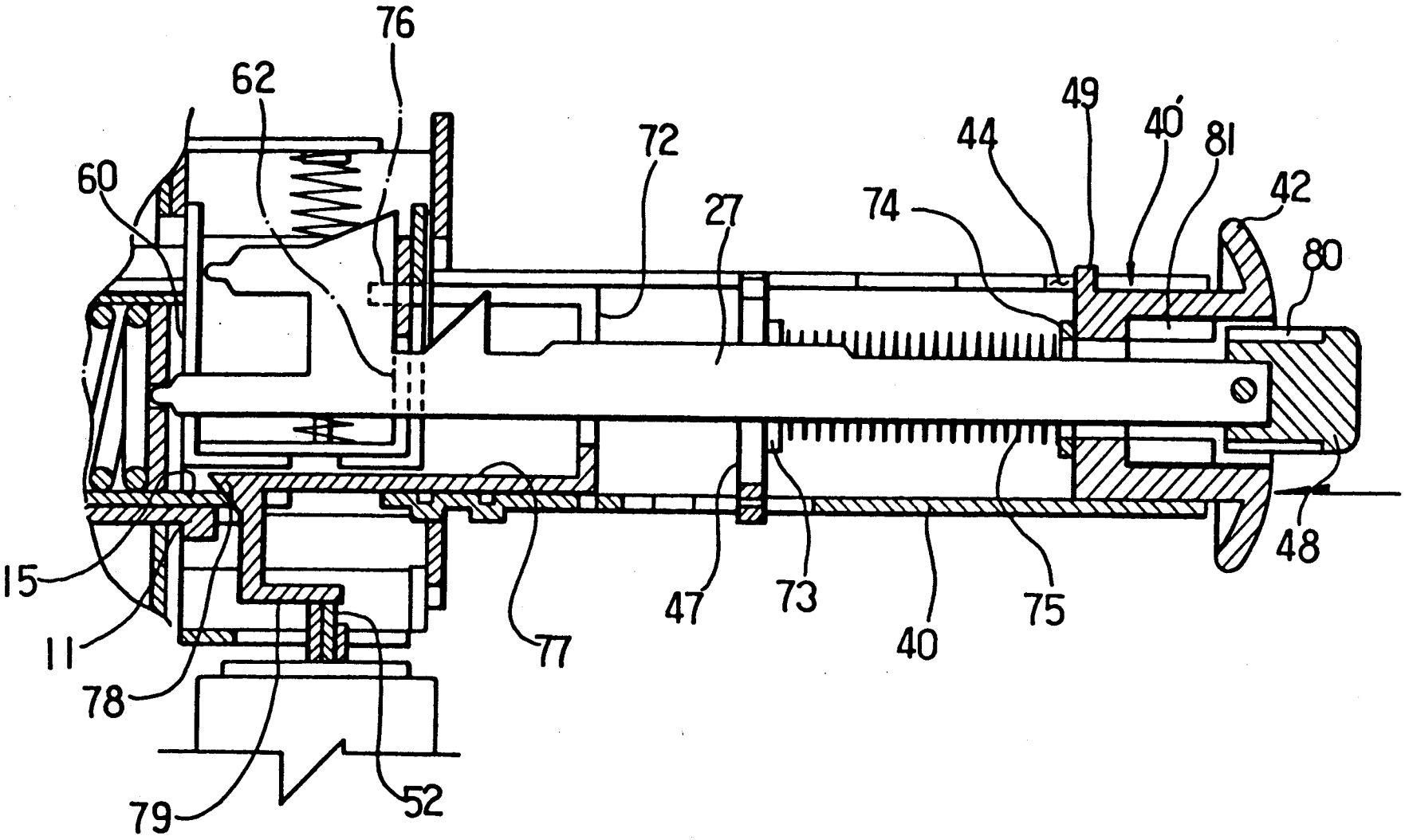
FIG. 12 is an enlarged view of the critical portion of FIG. 11.
Figure 13:
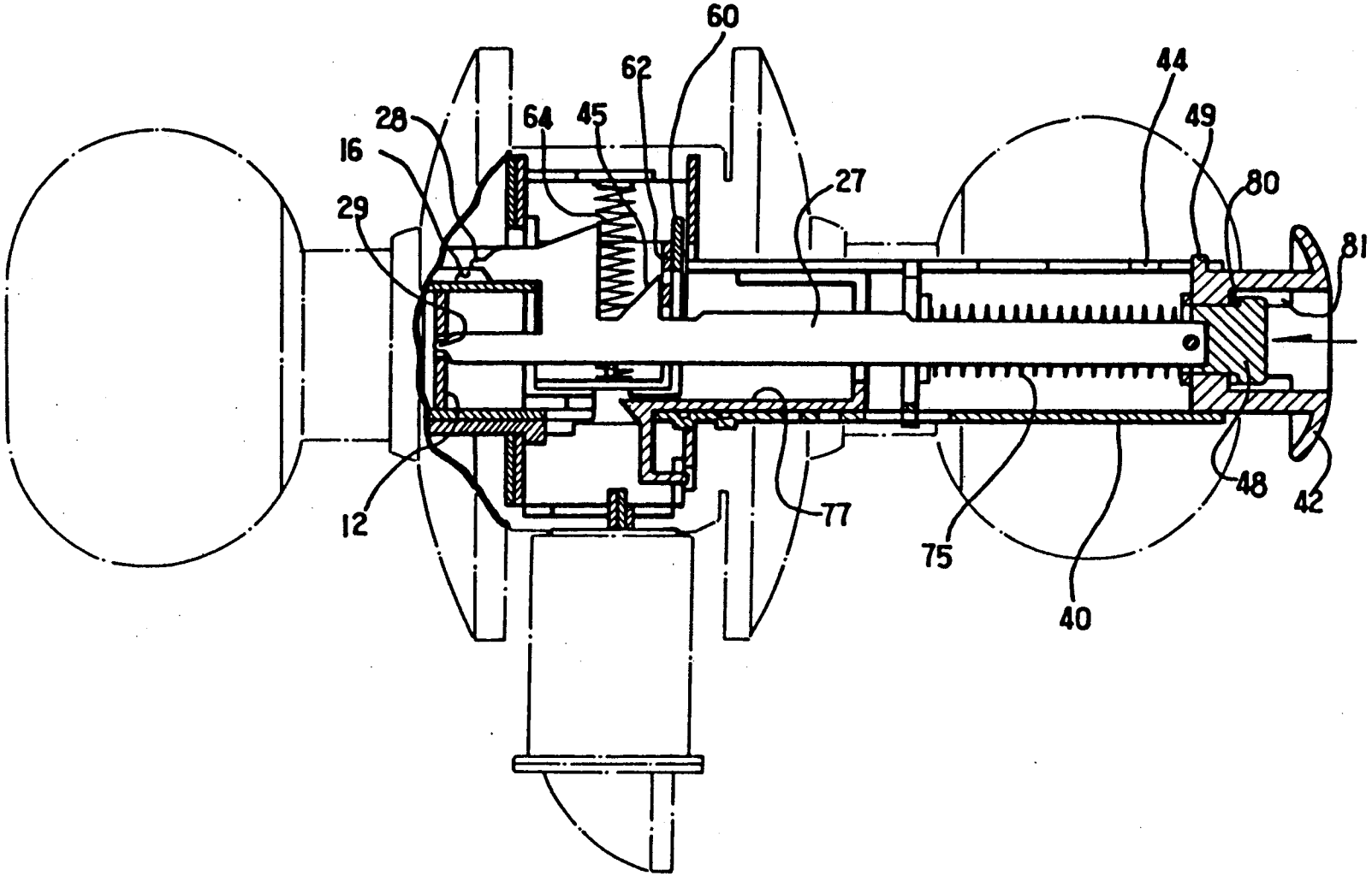
FIG. 13 is a sectional view of the door lock in a locked state upon pushing the push knob of the conventional door look.
Figure 14:
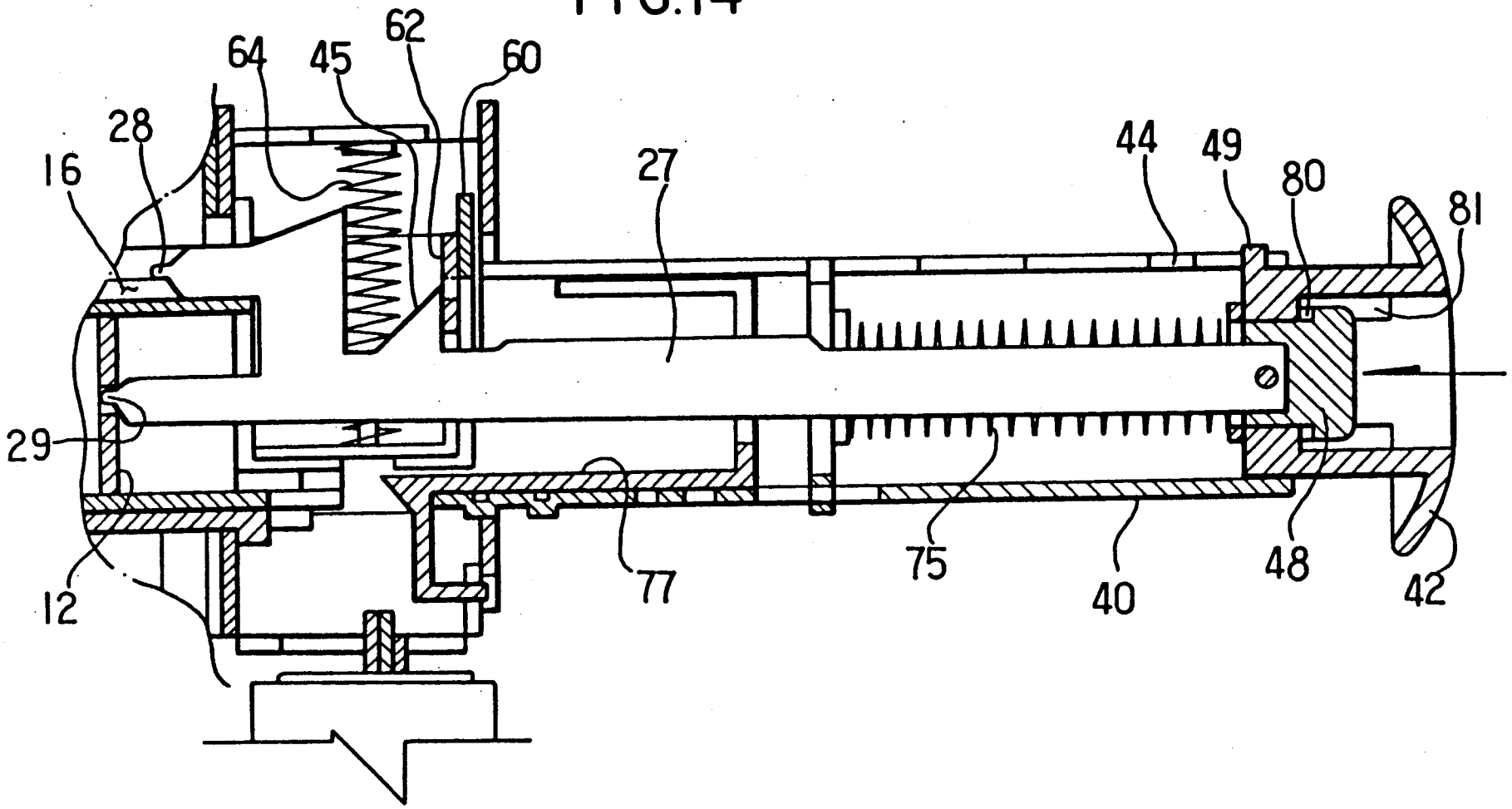
FIG. 14 is a sectional view of the critical portion of FIG. 13.

On the other hand, when a housewife is going out, if the push knob 48 is pushed as in the ordinary door lock, then the push knob 48 advances as shown in FIG. 11, and is inserted into the security device knob 42. At this instant, a protuberance 80 formed on the outside of the push knob 48 is engaged with a slot 81 formed on the inside of the security device knob 42, and therefore, even if the security device knob 42 is inserted into the interior of the movable tube 40, the security device knob 42 will not be rotated, so that the latching protuberance 49 can not be engaged with the latching slot 44. Therefore, the security device knob 42 will be restored to the original position due to the force of the spring 75, and therefore, the case that the door can not be opened due to the careless action committed when going out can not happen.

The unique features of the device of the present invention can be summarised as follows.

First, if the security device is activated from the inside of the room, the door can not be opened from the outside by any means, and therefore, the persons staying in the room can be perfectly protected from an unpermitted intruder.

Second, the external constitution of the door lock itself is same as conventionally known locking knob and therefore, the door lock of the present invention can replace existing door locks without adding any modification to the door.

Third, the device of the present invention is formed by adding a simple component to the existing door lock, and therefore, the door lock according to the present invention will be only slightly more expensive compared with the existing door lock to such a degree that it will be more economical to use the door lock of the present invention compared with the case of using an auxiliary lock.

What is claimed is:

1. In a door knob latch set having a locking mechanism of the push knob variety, including:

an outer handle, said outer handle being coupled with an outer rotating tube and an inner rotating tube, said outer rotating tube and said inner rotating tube having arcuate projections projecting from the end opposite said outer handle, and said inner rotating tube having an elastic support plate covering said end opposite said outer handle;

an inner handle having a push knob centrally disposed therethrough, said push knob being attached to a first end of a shaft, said shaft passing through a movable pipe and having at a second end a first leading end and a second leading end; and a cylinder, said cylinder having therethrough a latch elastically supported by a spring, said latch being connected at one end with a lower portion of a runner, said runner being coupled at an upper portion with a lock plate, said runner being coupled on a first side with said outer rotating tube, and said runner being coupled on a second side opposite said first side with said movable pipe;

THE IMPROVEMENT WHEREIN said lock plate is provided with at least one insertion slot, said arcuate projections of said inner rotating tube and said outer rotating tube being respectively provided with a centrally located insertion slot; and a security device being provided, said security device including a locking plate having a first integral locking pin and a second integral locking pin, two circular rods coupled with said locking plate, two springs installed on said circular rods, and a spring washer installed to the ends of said circular rods, said security device being inserted into said movable pipe adjacent to said inner handle, said security device having a knob projecting out from said inner handle and around said push knob, whereby said security device may be manipulated back and forth into said moveable pipe.

2. An improved door knob latch set in accordance with claim 1, further comprising a latching rod linked with said lock plate, and wherein said first locking pin has a leading end and a lower end, whereby engaging said security device by pushing said security device knob causes said leading end of said first locking pin to engage with said at least one insertion slots of said arcuate projections, and whereby said lower end of said first locking pin prevents the elevation of said latching rod.

3. An improved door knob latch set in accordance with claim 1, wherein said movable pipe is provided with a latching slot, and said security device knob is provided with a latching protuberance, said latching protuberance engaging said latching slot when said security device knob is pushed and turned clockwise, thereby securing the whole security device in the engaged position.

4. An improved door knob latch set in accordance with claim 1, wherein said second integral locking pin engages said insertion slot of said lock plate, thereby immobilizing said lock plate.

5. An improved door knob latch set in accordance with claim 1, said door lock having a push knob with a protuberance formed on an outer surface of said push knob, said protuberance being coupled with a slot formed in said security device knob, whereby said security device is disabled when said push knob is pushed in.

6. An improved door knob latch set in accordance with cm 1, wherein said locking plate, said washer, and said spring washer are provided with slots, said slots receiving said shaft when said security device is installed within said movable pipe.

* * * * *